US009583240B2

(12) United States Patent
Flachowsky et al.

(10) Patent No.: US 9,583,240 B2
(45) Date of Patent: Feb. 28, 2017

(54) TEMPERATURE INDEPENDENT RESISTOR

(71) Applicant: GLOBALFOUNDRIES Inc., Grand Cayman (KY)

(72) Inventors: Stefan Flachowsky, Dresden (DE); Ralf Illgen, Dresden (DE); Jan Hoentschel, Dresden (DE)

(73) Assignee: GLOBALFOUNDRIES Inc., Grand Cayman (KY)

( * ) Notice: Subject to any disclaimer, the term of this patent is extended or adjusted under 35 U.S.C. 154(b) by 191 days.

(21) Appl. No.: 14/469,012

(22) Filed: Aug. 26, 2014

(65) Prior Publication Data

US 2016/0064123 A1 Mar. 3, 2016

(51) Int. Cl.

| | |
|---|---|
| ***H01C 7/10*** | (2006.01) |
| ***H01C 1/16*** | (2006.01) |
| ***H01C 7/02*** | (2006.01) |
| ***H01C 7/04*** | (2006.01) |
| ***H01C 7/00*** | (2006.01) |
| ***H01C 17/075*** | (2006.01) |

(52) U.S. Cl.

CPC ..... *H01C 1/16* (2013.01); *H01C 7/008* (2013.01); *H01C 7/021* (2013.01); *H01C 7/027* (2013.01); *H01C 7/041* (2013.01); *H01C 17/075* (2013.01)

(58) Field of Classification Search

CPC ..... H01C 1/16; H01C 7/021; H01C 7/027; H01C 7/041; H01C 7/18; H01C 7/008; H01C 17/075

USPC ..... 338/22 SD, 13

See application file for complete search history.

(56) References Cited

U.S. PATENT DOCUMENTS

| | | | | | |
|---|---|---|---|---|---|
| 3,496,377 | A * | 2/1970 | Rice | G05B 19/07 | 307/117 |
| 3,863,210 | A * | 1/1975 | Roland | G01F 23/247 | 323/369 |
| 5,820,995 | A * | 10/1998 | Niimi | C04B 35/465 | 338/22 R |
| 6,492,629 | B1 * | 12/2002 | Sopory | H05B 1/0205 | 219/485 |
| 8,624,703 | B2 * | 1/2014 | Miura | H01C 7/008 | 338/22 R |
| 2002/0118091 | A1 * | 8/2002 | Kawase | H01C 1/14 | 338/22 R |
| 2009/0231067 | A1 * | 9/2009 | Yan | H03H 7/24 | 333/81 A |
| 2013/0200989 | A1 * | 8/2013 | Miura | H01C 7/008 | 338/22 SD |
| 2014/0205336 | A1 * | 7/2014 | Chu | H01C 7/021 | 399/333 |

* cited by examiner

*Primary Examiner* — Kyung Lee
(74) *Attorney, Agent, or Firm* — Amerson Law Firm, PLLC

(57) ABSTRACT

The present disclosure relates to a semiconductor structure comprising a positive temperature coefficient thermistor and a negative temperature coefficient thermistor, connected to each other in parallel by means of connecting elements which are configured such that the resistance resulting from the parallel connection is substantially stable in a predetermined temperature range, and to a corresponding manufacturing method.

13 Claims, 7 Drawing Sheets

TEMPERATURE INDEPENDENT RESISTOR

BACKGROUND OF THE INVENTION

1. Field of the Invention

Generally, the present disclosure relates to highly sophisticated semiconductor structures, and, in particular, to a resistor which has a resistance value substantially stable in a range of operating temperatures and a manufacturing method thereof. Further, the disclosure relates to the integration of such a resistor in a manufacturing flow, such flow optionally comprising the manufacturing of transistors having a metal gate.

2. Description of the Related Art

The fabrication of advanced integrated circuits, such as CPUs, storage devices, application specific integrated circuits (ASICs) and the like, requires the formation of a large number of circuit elements on a given chip area according to a specified circuit layout. Among the various elements, resistors are often needed.

The specific characteristic of a given resistor depends on its design features, such as its thickness, width and length, on its physical features, such as what implant base and materials are used, as well as the quantity of the implant. One physical feature intrinsic to any given material is the relation between its resistivity value and the operating temperature.

In particular, while a given material may have a nominal resistance value, its actual resistance is susceptible to changing as a function of the temperature of the material.

In particular, a material may experience a so-called positive temperature coefficient type of resistance, in which the resistance increases with the increase of the temperature, or a negative temperature coefficient type of resistance, in which the resistance decreases when the temperature increases.

In view of this situation, the present disclosure relates to a semiconductor structure and manufacturing techniques capable of obtaining a resistor which has a substantially stable resistance value, over a given temperature range, preferably as broad as possible, and further preferably without further incurring in the realization of steps in addition to those usually carried out in a CMOS process flow.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Generally, the present invention solves the above-mentioned problem by combining a positive temperature characteristic resistance and a negative temperature characteristic resistance. This is achieved by controlling the resistance of the contact regions such that the current will partially flow through the positive temperature resistance and through the negative temperature resistance, thereby compensating for their opposite behavior.

One illustrative embodiment can relate to a semiconductor structure comprising a positive temperature coefficient thermistor and a negative temperature coefficient thermistor, connected to each other in parallel by means of connecting elements which are configured such that the resistance resulting from the parallel connection is substantially stable in a predetermined temperature range.

In further advantageous embodiments, the positive temperature coefficient thermistor may be formed by a first resistive region which, in a CMOS process flow, may also be used as part of a metal gate layer.

In further advantageous embodiments, the first resistive region may comprise TiN and/or TiAlN.

In further advantageous embodiments, the negative temperature coefficient thermistor may be formed by a second resistive region which, in a CMOS process flow, may also be used as part of a silicide gate layer.

In further advantageous embodiments, the second resistive region may comprises any of silicon, polysilicon, SiGe or Ge, any of them doped or intrinsic.

In further advantageous embodiments, the connecting elements may comprise any of silicon, polysilicon, SiGe or Ge, any of them doped or intrinsic.

One further illustrative embodiment may relate to a manufacturing method for a semiconductor structure including the steps of realizing a positive temperature coefficient thermistor, realizing a negative temperature coefficient thermistor, and realizing connecting elements connecting the first resistive region in parallel with the second resistive region.

In further advantageous embodiments, the step of realizing the positive temperature coefficient thermistor may comprise realizing a first resistive region which, in a CMOS process flow, may also be used as part of a metal gate layer.

In further advantageous embodiments, the step of realizing the first resistive region may comprise depositing TiN and/or TiAlN.

In further advantageous embodiments, the step of realizing the negative temperature coefficient thermistor may comprise realizing a second resistive region which, in a CMOS process flow, may also be used as part of a silicide gate layer.

In further advantageous embodiments, the step of realizing the second resistive region may comprise depositing any of silicon, polysilicon, SiGe or Ge, any of them doped or intrinsic.

In further advantageous embodiments, the step of realizing the connecting elements may comprise depositing any of silicon, polysilicon, SiGe or Ge, any of them doped or intrinsic.

BRIEF DESCRIPTION OF THE DRAWINGS

The disclosure may be understood by reference to the following description taken in conjunction with the accompanying drawings, in which like reference numerals identify like elements, and in which:

FIG. 3*c* schematically illustrates the resistance behavior with respect to the temperature of the structure of FIGS. 3*a.

Figure 1A:
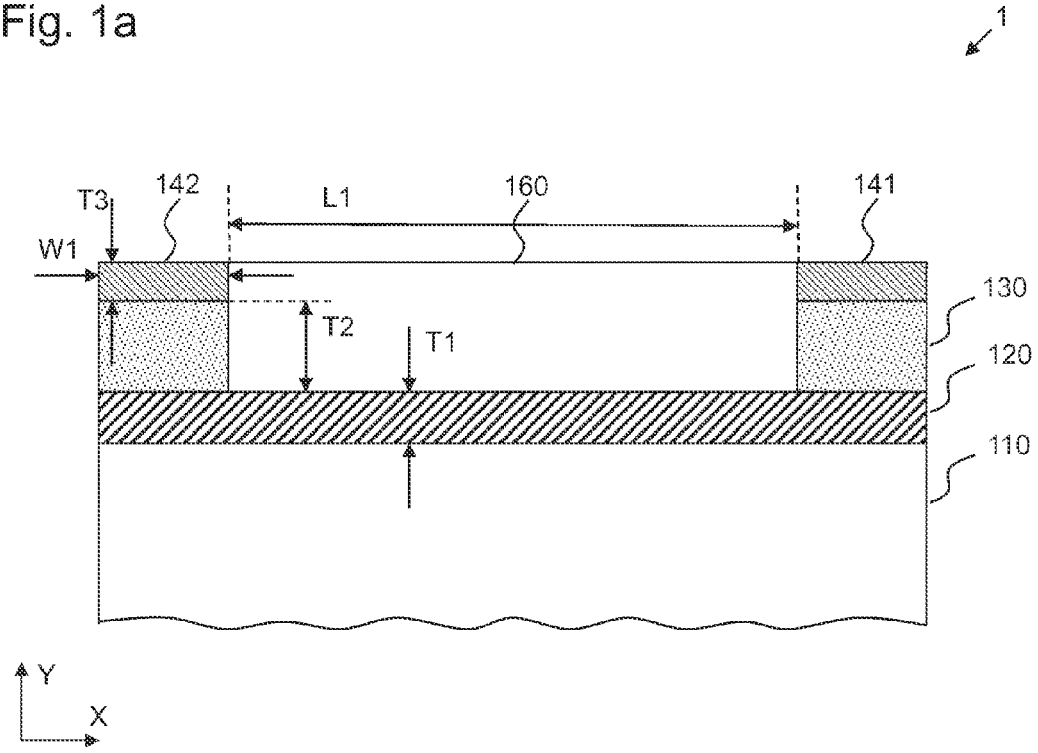
FIG. 1*a* schematically illustrates a cut view of a semiconducting structure according to illustrative embodiments of a stable temperature coefficient thermistor.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The following embodiments are described in sufficient detail to enable those skilled in the art to make use of the invention. It is to be understood that other embodiments would be evident, based on the present disclosure, and that system, structure, process or mechanical changes may be made without departing from the scope of the present disclosure. In the following description, numeral-specific details are given to provide a thorough understanding of the disclosure. However, it would be apparent that the embodiments of the disclosure may be practiced without the specific details. In order to avoid obscuring the present disclosure, some well-known circuits, system configurations, structure configurations and process steps are not disclosed in detail.

The present disclosure will now be described with reference to the attached figures. Various structures, systems and devices are schematically depicted in the drawings for purposes of explanation only and so as to not obscure the present disclosure with details which are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary or customary meaning as understood by those skilled in the art, is intended to be implied by consistent usage of the term or phrase herein. To the extent that a term or phrase is intended to have a special meaning, i.e., a meaning other than that understood by skilled artisans, such a special definition shall be expressively set forth in the specification in a definitional manner that directly and unequivocally provides the special definition for the term or phrase.

Figure 2A:
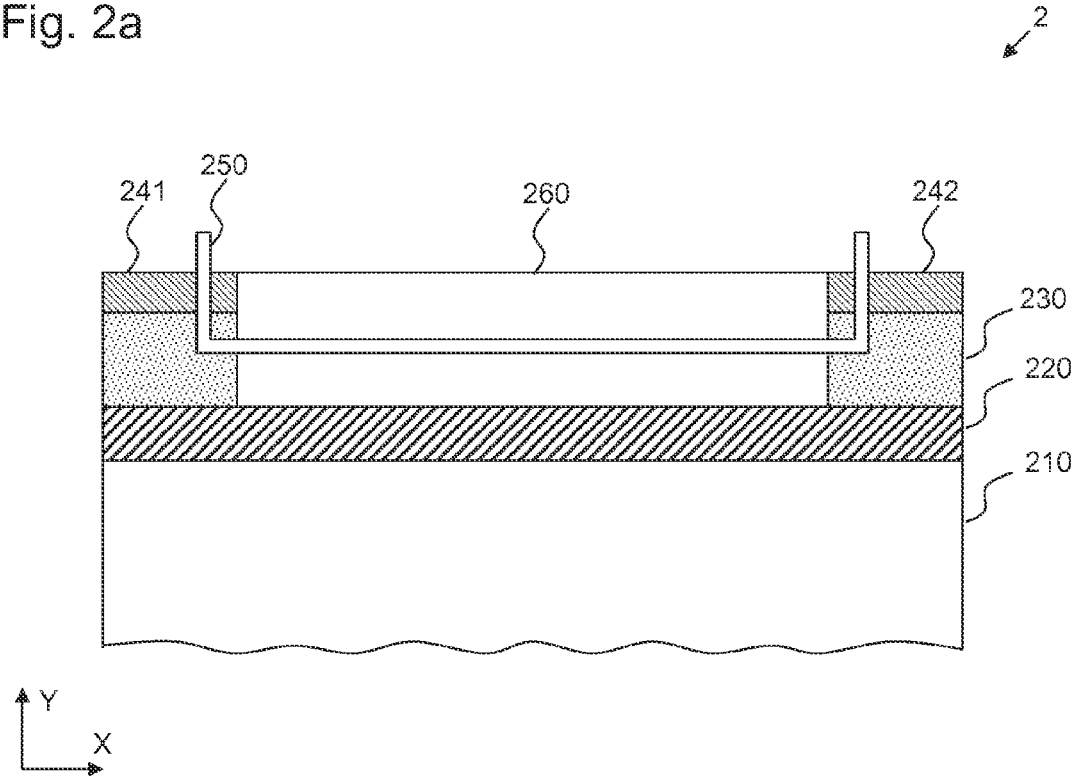
FIG. 2*a* schematically illustrates a cut view of a semiconducting structure according to illustrative embodiments of a negative temperature coefficient thermistor.

FIG. 2*a* schematically illustrates a Negative Temperature Coefficient (in the following NTC) thermistor 2. The thermistor 2 comprises an insulating region 210, being, for instance, a silicon oxide $SiO_2$ region. On top of the insulating region 210, a first resistive region 220 is realized, for instance, a metal region. On top of the first resistive region 220, a second resistive region 260 is realized which could be, for instance, a polysilicon region. The first and second resistive regions have different temperature behaviors. In particular, the first resistive region 220 has positive temperature characteristics, while the second resistive region 260 has negative temperature characteristics. At the same level of the second resistive region 260, two vias 230, which could be made of, for instance, doped polysilicon, are topped by two contacts 241 and 242. The contact may be realized, for instance, by metal or by doped semiconductor, such as polysilicon.

Figure 2B:
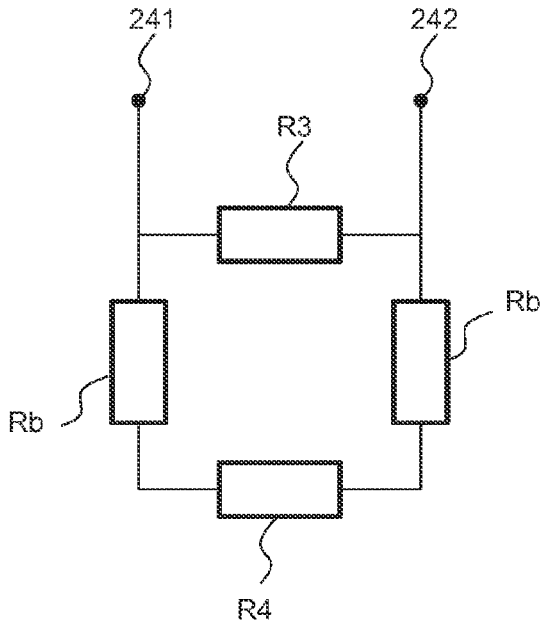
FIG. 2*b* schematically illustrates an electrical scheme of the structure of FIG. 2*a;*

FIG. 2*b* schematically illustrates four resistance R3, R4 and twice resistance Rb and is a schematic electrical representation of the thermistor 2 of FIG. 2*a*. In particular, resistance R3 schematically corresponds to second resistive region 260, resistance R4 schematically corresponds to first resistive region 220, and each resistance Rb schematically correspond to one via 230. As can be seen from FIG. 2B, the final resistance between contacts 241 and 242 will then be the result of resistance R3 in parallel with the series of resistance Rb, R4 and Rb.

Figure 2C:
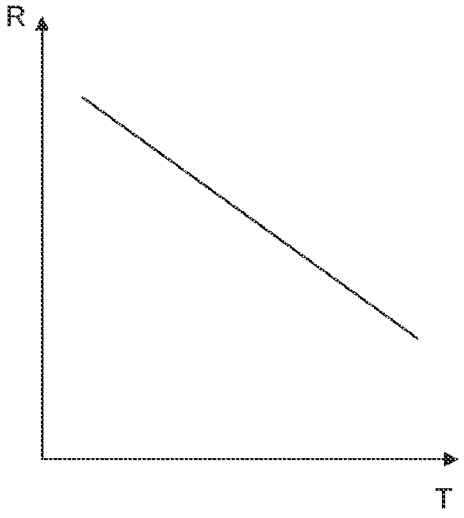
FIG. 2*c* schematically illustrates the resistance behavior with respect to the temperature of the structure of FIG. 2*a;*

When the value of resistance Rb is higher than the resistance of R3, the current between contacts 241 and 242 mostly flows through resistance R3. A schematic representation of such current path 250 is illustrated in FIG. 2*a*. If resistance R3, namely second resistive region 260 is, for instance, realized by a doped semiconductor having a negative temperature characteristic, the total resistance R between contacts 241 and 242 will exhibit a negative temperature coefficient behavior with respect to temperature T, as illustrated in FIG. 2*c*.

Figure 3A:
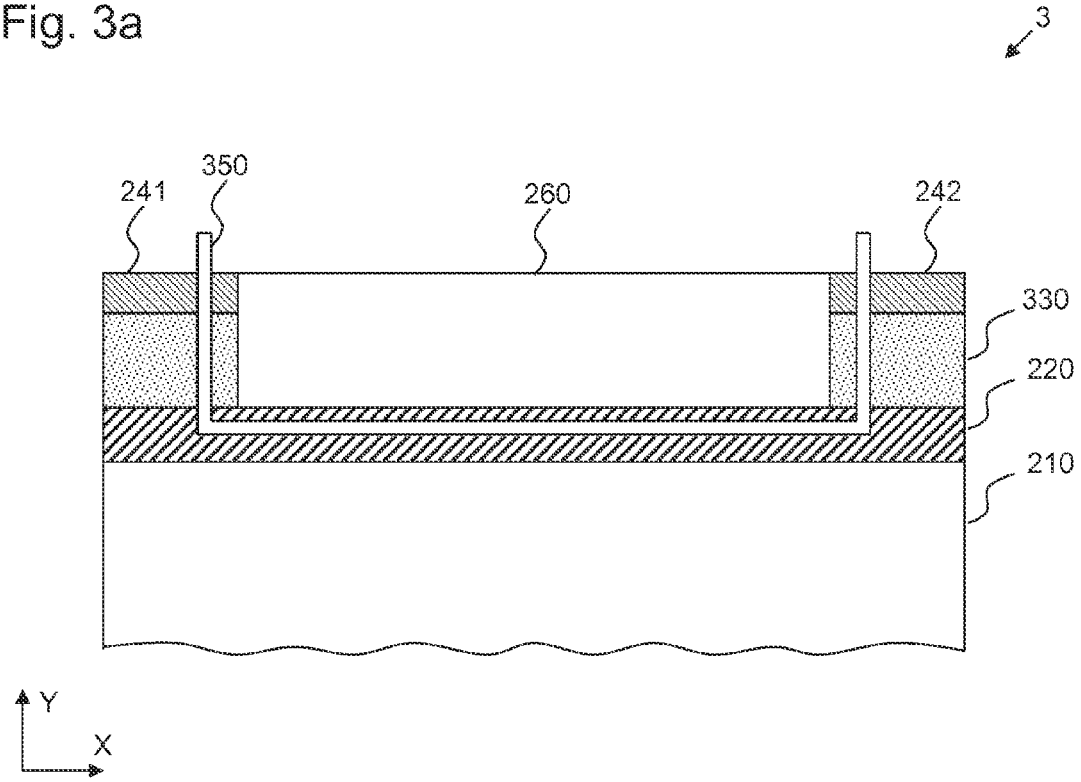
FIG. 3*a* schematically illustrates a cut view of a semiconducting structure according to illustrative embodiments of a positive temperature coefficient thermistor.
Figure 3B:
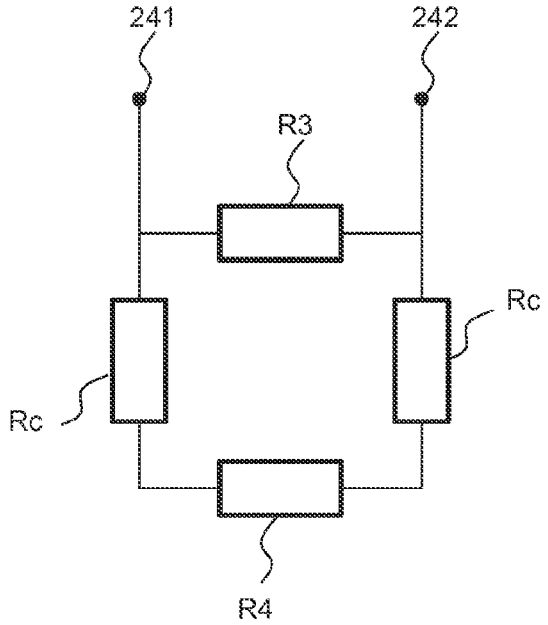
FIG. 3*b* schematically illustrates an electrical scheme of the structure of FIG. 3*a;*
Figure 3C:
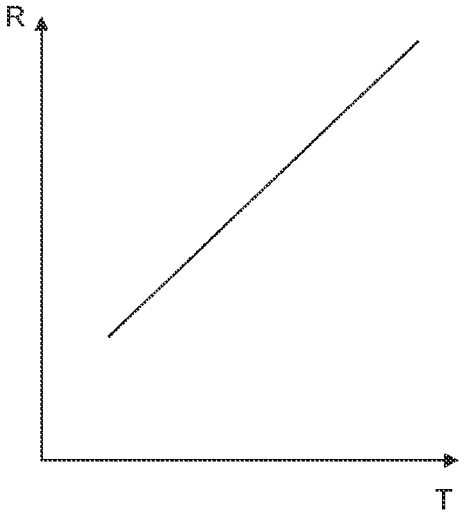

Conversely, FIGS. 3*a*-3*c* schematically illustrate a case of a positive temperature coefficient (in the following PTC) thermistor 3. In particular, here, it is assumed that the device mainly differs from the one illustrated in FIG. 2*a* due to a different resistance value of vias 230, here therefore differently indicated as vias 330. By changing the resistance of the vias 330, the resistances Rb are replaced by resistances Rc in FIG. 2*b*.

When, for instance, the value of resistance Rc is lower than the value of resistance R3, and assuming that the value of resistance R4 is lower than the value of resistance R3, most of the current in the resistance R3 will tend to flow through the path 350 going through vias 330, and first resistive region 220, rather than through second resistive region 260. If the first resistive region 220 is a metallic region having, for instance, a positive temperature characteristic, the behavior of FIG. 3*c* is obtained in which the resistance value R increases with the increase of temperature T.

Figure 1B:
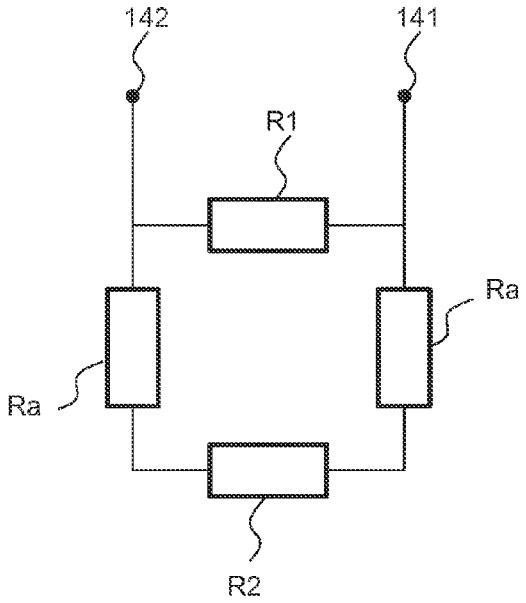
FIG. 1*b* schematically illustrates an electrical scheme of the structure of FIG. 1*a;*
Figure 1C:
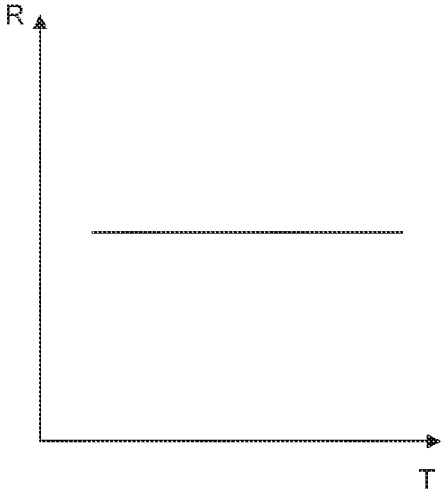
FIG. 1*c* schematically illustrates the resistance behavior with respect to the temperature of the structure of FIG. 1*a;*

In FIG. 1*a*, a cut view of a semiconductor structure 1 implementing a resistance having an approximately stable resistance value over a given temperature range is illustrated. In FIG. 1*b*, an electrical schematic representation of the semiconductor structure of FIG. 1*a* is schematically illustrated. FIG. 1*c* schematically illustrates the resistance R of the semiconductor structure of FIG. 1*a* with respect to the temperature T.

The semiconductor structure 1 of FIG. 1*a* comprises an insulating region 110 which may, for instance, be a silicon oxide region. This could be, for instance, a shallow trench insulation (STI) region, an insulating portion of a silicon-on-insulator (SOI) wafer, a thin layer of insulator realizing a CMOS gate insulating layer, or more generally any material that provides electrical insulation. Alternatively, insulating region 110 may also be a low doped semiconductor region, such that although not entirely insulating, its electrical resistance does not affect the resistance of the layer over it.

Above the insulating region 110, a first resistive region 120 is realized. Although not illustrated, additional layers could be present between regions 110 and 120, as it will be clear to those skilled in the art, for instance due to manufacturing or process flow constraints, and as shown, for instance, in the embodiment of FIGS. 4*a*-4*h*. First resistive region 120 may be, for instance, a metallic region, where the metal could be, for instance, any of TiN, TiAlN, etc., and preferably, TiN. It will be clear to those skilled in the art that a combination of those materials may also be implemented, as long as the first resistive region provides a resistance having a temperature dependence either positive or negative. In advantageous embodiments, the first resistive region could also be used as at least part of a metallic portion of a CMOS gate, as will be shown for transistor T1 of the embodiment of FIGS. 4*a*-4*h*. In a specific embodiment, the first resistive region 120 may have a thickness T1 in direction Y in the range of 2-20 nm, preferably with a value of 5 nm.

Above region 120 on the left and right sides of FIG. 1*a* in the X direction, two vias 130, are realized. Although not illustrated, additional layers could be present between region 120 and vias 130, as it will be clear to those skilled in the art, for instance due to manufacturing or process flow constraints. The vias 130 may be realized by means of a semiconducting material such as, for instance, silicon, polysilicon, SiGe or Ge, any of them doped or intrinsic, and preferably doped polycrystalline silicon.

In a specific embodiment, each of vias 130 may have a thickness T2 in the Y direction in the range of 20-80 nm, and a preferred value of 50 nm. Similarly, each of the vias 130 may have a width W1 in the X direction in the range of 50-500 nm, and a preferred value of 100 nm. Vias 130 are used in order to provide an electrical connection to the first resistive region 120 and can therefore conduct electricity. When realized of semiconducting material they may thus be advantageously doped with any of boron, BF2, arsenic or phosphorous, and preferably boron with a concentration in the range of 1e20-5e20 atoms/$cm^3$, preferably with a value of 2e20 atoms/$cm^3$.

Above each of vias 130, one contact is realized, namely contact 141 on the right and 142 on the left. Although not illustrated, additional layers could be present between contacts 141 and 142 and vias 130, as it will be clear to those skilled in the art, for instance due to manufacturing or process flow constraints. Contacts 141 and 142 allow a voltage potential or a current to be applied to semiconductor structure 1. Each of contacts 141 and 142 may be realized by means of, for instance, any kind of silicide, e.g., NiSi, CoSi, TiSi, and preferably NiSi. In a specific embodiment, each of contacts 141 and 142 may have a thickness T3 in the Y direction in the range of 2-20 nm, and a preferred value of 5 nm.

Above the first resistive region 120, and in between vias 130, a second resistive region 160 is realized. The second resistive region 160 may be, for instance, a semiconductor region made of, for instance, any of silicon, polysilicon, SiGe or Ge, any of them doped or intrinsic, and preferably doped polysilicon. It will be clear to those skilled in the art that a combination of those materials may also be implemented, as long as the second resistive region provides a resistance having a temperature dependence either positive or negative, in particular a temperature dependence opposite to that of the first resistive region. In advantageous embodiments, the second resistive region 160 could also be used as a portion of a CMOS gate, as will be shown with reference to the embodiment of FIGS. 4*a*-4*h*. In a specific embodiment, the second resistive region 160 may have a length L1 in the X direction in the range of 100 nm to 10 μm, preferably with a value of 1 μm.

Although a top view of semiconductor structure 1 is not illustrated, it will be clear to those skilled in the art that the semiconductor structure 1 also extends in a direction Z perpendicular to directions X and Y. The value of the dimension of the semiconductor structure 1 in the non-illustrated direction Z, could be in the range of 200 nm to 10 μm, with a preferred value of 5 μm.

Although the second resistive region 160 is shown as being in direct contact with contacts 141 and 142, vias 130 and the second resistive region 160, the present invention is not limited thereto. Alternatively, or in addition, the second resistive region 160 could be electrically connected only to contacts 141 and 142 and electrically and physically separated from the first resistive region 120 and vias 130 by means of non-illustrated insulating layers. Similarly, the second resistive region 160 could be electrically connected only to contacts 141 and 142 and vias 130 and electrically and physically separated from the first resistive region 120 by means of non-illustrated insulating layers. In general, any configuration that allows current to flow through at least contacts 141 and 142 and the first and second resistive regions 120 and 160 may be implemented.

By appropriately tuning the resistance value of vias 130, the amount of current flowing through the first resistive region 120 and second resistive region 160 may be finely tuned. In particular, by tuning the current flowing through the first and second resistive regions 120 and 160, their opposite temperature dependence may cancel each other, and provide a combined value of resistance that is substantially temperature independent, over at least a predetermined temperature range, for instance on the order of −50° C. to +100° C.

In the following, a possible manufacturing method for a semiconductor structure 1A and a transistor T1 is schematically described. It will be appreciated by those skilled in the art how the manufacturing steps required for the fabrication of the semiconductor structure 1A may be easily integrated, preferably, without the addition of any mask or processed step in a standard CMOS process. It will be further clear to those skilled in the art that not all process steps, for the sake of conciseness and clarity, are reported in detail and that routine process steps may be added by those skilled in the art, if needed. It will also be clear to those skilled in the art that the semiconductor structure 1A may be realized independently of the transistor T1.

Figure 4A:
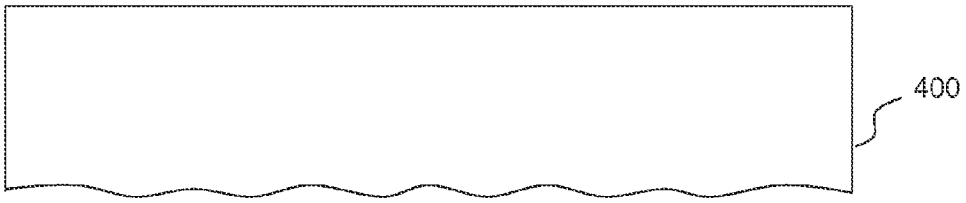
* and FIGS. 4A-4H schematically illustrate a manufacturing process for a semiconducting structure according to illustrative embodiments of a stable temperature coefficient thermistor.

In a first step illustrated in FIG. 4*a*, a wafer 400 is blanked. The wafer 400 could be a silicon wafer or, more generally, any support which may be used for further semiconductor manufacturing techniques, such as an SiGe wafer, an SOI wafer, a glass wafer, etc.

Figure 4B:
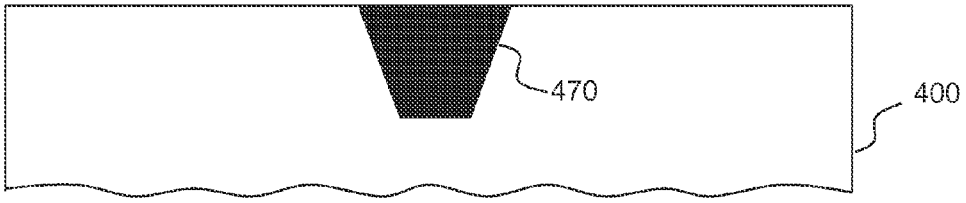

In a subsequent step, illustrated in FIG. 4*b*, a shallow trench insulation 470 is formed within the wafer 400. The shape and size of the shallow trench insulation 470 is such that electrical connection between the semiconducting structure 1A and transistor T1 (see FIGS. 4*d*-4*h*) is avoided. As will be clear to those skilled in the art, the shallow trench insulation 470 is optional and may be avoided if, for instance, only the semiconducting structure 1A is realized, without the transistor T1, or if, for instance, those two elements are electrically disconnected by other means of, for instance, one or more diodes.

Figure 4C:
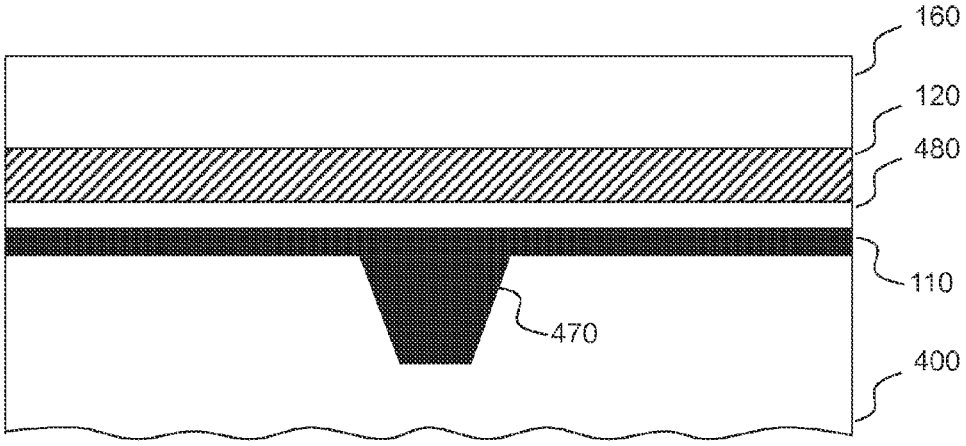

In a subsequent step, illustrated in FIG. 4*c*, layers 110, 480, 120 and 160 are realized. They could be realized by deposition, such as chemical vapor deposition (CVD) or physical vapor deposition (PVD), growth, such as epitaxial growth, printing, or any other common semiconductor manufacturing technology. The layer 110 corresponds to the insulating layer 110 of the embodiment of FIG. 1*a*. The layer 120 corresponds to the first resistive region 120 of the embodiment of FIG. 1*a*. The layer 160 corresponds to the second resistive region 160 of the embodiment of FIG. 1*a*. The layer 480 is optionally realized in this embodiment between the layers 110 and 120 for better electrical performances and could be a high-k metallic region. The dependence of resistance of the layer 480 with respect to temperature T could be, for instance, substantially similar to that of the layer 120, or it could be neutral. In both cases, the layer 480 may be structured such that the semiconducting structure 1A has an electrical behavior substantially similar to that of the semiconducting structure 1.

Figure 4D:
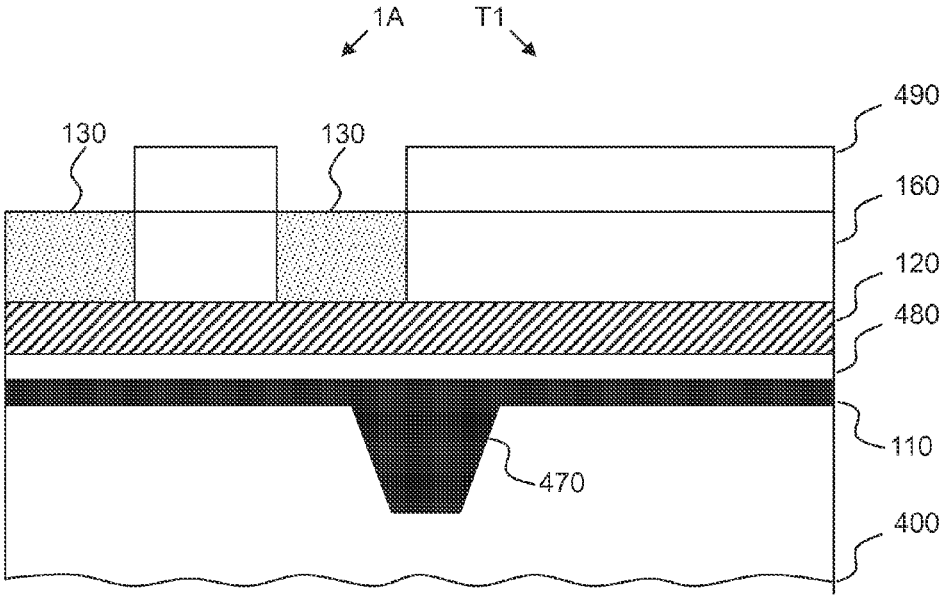

In a subsequent step, illustrated in FIG. 4*d*, a mask 490 is realized on top of the layer 160, it is etched in the regions corresponding to vias 130, and the vias 130 are obtained by doping of the layer 160.

Figure 4E:
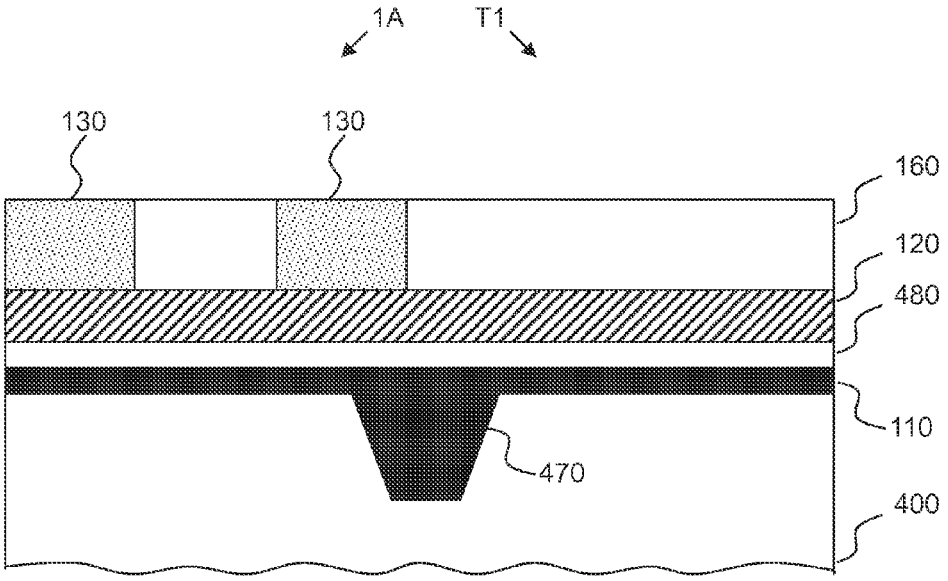

In a subsequent step, illustrated in FIG. 4*e*, the mask 490 is removed. At this point, the semiconducting structure 1A is finalized. The remaining steps illustrate how the process may also be advantageously used in parallel for the realization of the transistor T1 which is, however, optional.

Figure 4F:
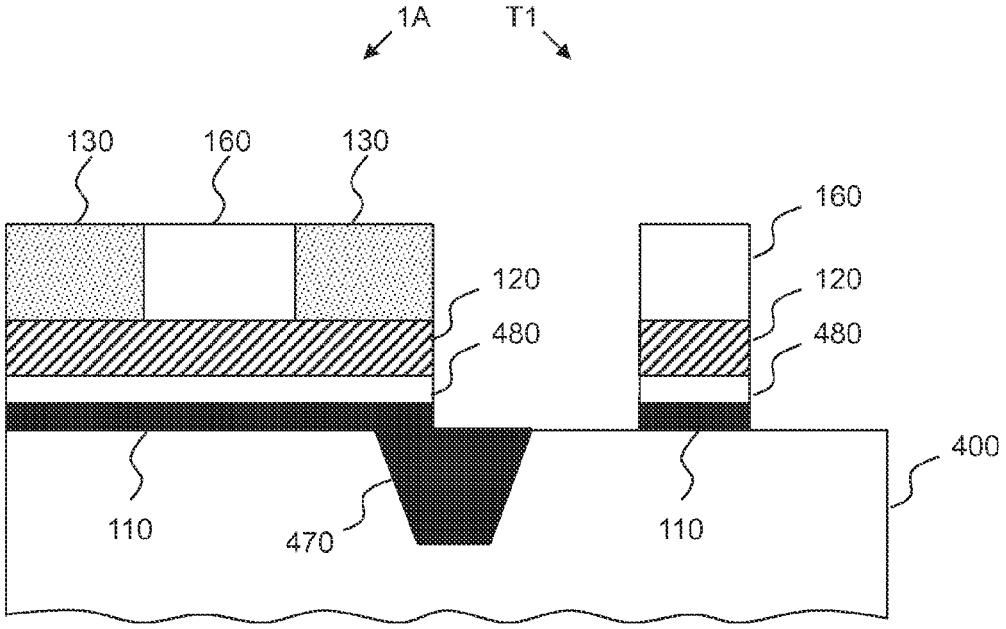

In a subsequent step, illustrated in FIG. 4*f*, the gate stack of transistor T1 is realized by selectively removing layers 110 to 160 around the gate stack. The removal may be achieved, for instance, by a mask and etch technique, not illustrated. It can be seen how the lateral placement of the gate stack is selected such that enough space remains between the shallow trench insulation 470 and the gate stack for the realization of a source or drain region.

Figure 4G:
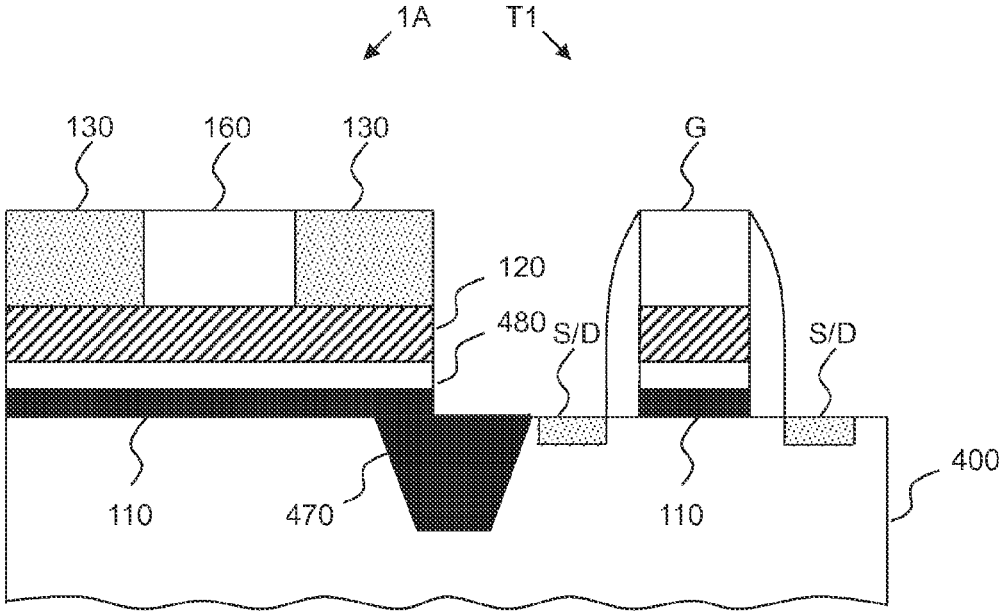

In a subsequent step, illustrated in FIG. 4*g*, source and drain S/D regions are realized. The details of this realization will not be described as they are not relevant to the semiconducting structure 1A. It will nevertheless be clear to those skilled in the art that several implementing processes may be employed in accordance with common semiconductor technology.

Figure 4H:
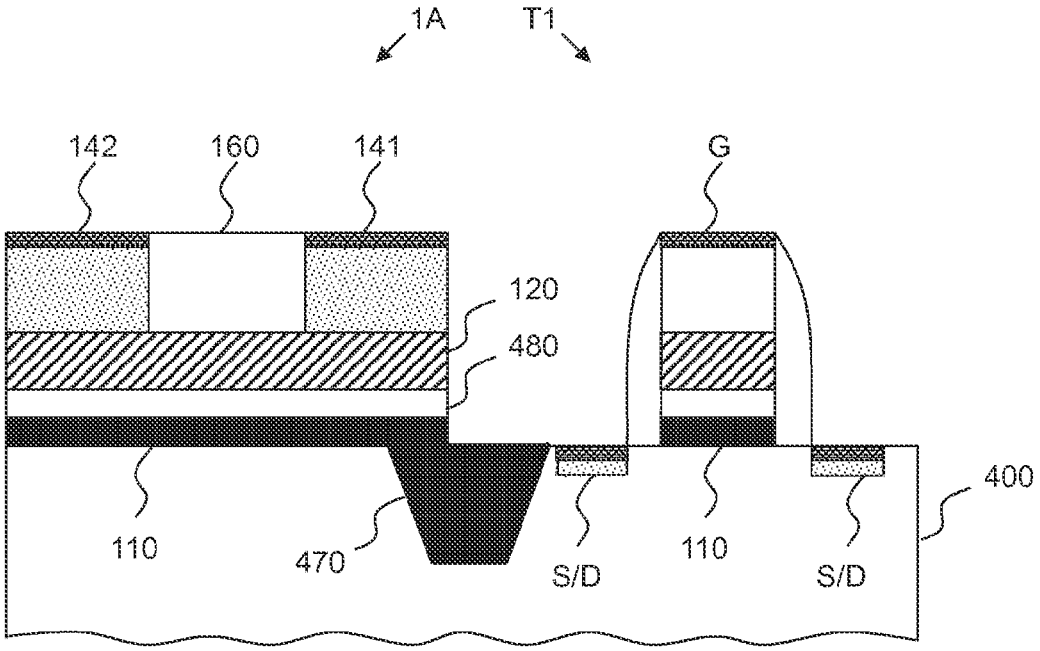

In a subsequent step, illustrated in FIG. 4*h*, silicide regions are realized on top of region 160, S/D regions, and the gate stack, respectively, resulting in contacts 141 and 142 of semiconducting structure 1A, silicide S/D regions and gate G of transistor T1.

As it can be seen, thanks to the advantageous manufacturing process illustrated in FIGS. 4*a*-4*h*, a semiconducting structure 1A with a temperature independent resistance analog to semiconducting structure 1 may be obtained in parallel with a high-k metal gate transistor T1. Thus, no additional steps or materials are required for the integration of the temperature independent resistor of semiconducting structure 1A in a standard CMOS process.

In a further alternative embodiment, if needed, any of layers 480, 120 and 160 of semiconducting structure 1A may be doped differently than the same layer in transistor T1, so as to obtain the intended temperature behavior of semiconducting structure 1A.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is, therefore, evident that the particular embodiments disclosed above may be altered or modified and all such variations are considered within the scope and spirit of the invention. Accordingly, the protection sought herein is as set forth in the claims below.

What is claimed:

1. A method of manufacturing an integrated circuit product, comprising the steps of:

forming a positive temperature coefficient thermistor that comprises a first resistive region, wherein forming said positive temperature coefficient thermistor comprises forming a metal-containing layer and performing at least one patterning process to define said first resistive region from said metal-containing layer and to define a metal-containing gate structure for a transistor that comprises a portion of said metal-containing layer;

forming a negative temperature coefficient thermistor that comprises a second resistive region; and forming a plurality of connecting elements connecting said first resistive region in parallel with said second resistive region.

2. The method of claim 1, wherein forming said metal-containing layer comprises depositing at least one of TiN and TiAlN.

3. The method of claim 1, wherein the step of forming said negative temperature coefficient thermistor comprises forming a silicon-containing semiconductor material layer and performing at least one patterning process to define said second resistive region from said silicon-containing semiconductor material layer and to define a portion of a gate structure for a transistor.

4. The method of claim 3, wherein the step of forming said silicon-containing semiconductor material layer comprises depositing one of silicon, polysilicon or SiGe.

5. The method of claim 1, wherein forming said plurality of connecting elements comprises depositing one of silicon, polysilicon, SiGe or Ge.

6. A method of manufacturing an integrated circuit product, comprising:

forming an isolation structure in a semiconductor substrate, said isolation structure being positioned between first and second regions of said substrate;

depositing a layer of insulating material above said first and second regions;

depositing a first metal-containing layer of material above said layer of insulating material and above said first and second regions;

depositing a semiconductor material layer above said first metal-containing layer of material and above said first and second regions;

forming a plurality of conductive contacts above said first region, said conductive contacts extending through said semiconductor material layer and contacting said first metal-containing layer of material positioned above said first region and contacting a remaining portion of said semiconductor material layer positioned above said first region; and performing at least one process operation to pattern at least said semiconductor material layer, said first metal-containing layer of material and said layer of insulating material so as to define at least a portion of a gate structure of a transistor, said gate structure being positioned above said second region.

7. The method of claim 6, wherein said first metal-containing layer of material positioned above said first region constitutes a first resistive region of a positive temperature coefficient thermistor and said remaining portion of said semiconductor material layer positioned above said first region constitutes a second resistive region of a negative temperature coefficient thermistor.

8. The method of claim 6, wherein depositing said first metal-containing layer comprises depositing at least one of TiN and TiAlN.

9. The method of claim 8, wherein depositing said semiconductor material layer comprises depositing one of silicon, polysilicon or SiGe.

10. The method of claim 9, wherein forming said plurality of conductive contacts comprises depositing one of silicon, polysilicon, SiGe or Ge.

11. A method of manufacturing an integrated circuit product, comprising the steps of:

forming a positive temperature coefficient thermistor that comprises a first resistive region;

forming a negative temperature coefficient thermistor that comprises a second resistive region, wherein said negative temperature coefficient thermistor comprises forming a silicon-containing semiconductor material layer and performing at least one patterning process to define said second resistive region from said silicon-containing semiconductor material layer and to define a portion of a gate structure for a transistor; and forming a plurality of connecting elements connecting said first resistive region in parallel with said second resistive region.

12. The method of claim 11, wherein the step of forming said silicon-containing semiconductor material layer comprises depositing one of silicon, polysilicon or SiGe.

13. The method of claim 11, wherein forming said plurality of connecting elements comprises depositing one of silicon, polysilicon, SiGe or Ge.

* * * * *